United States Patent [19]

Copp

[11] Patent Number: 4,677,713

[45] Date of Patent: Jul. 7, 1987

[54] ORONASAL MASK ASSEMBLIES

[75] Inventor: Warren K. Copp, Fleet, England

[73] Assignee: The Secretary of State for Defence in Her Britannic Majesty's Government of the United Kingdom of Great Britain and Northern Ireland, London, England

[21] Appl. No.: 843,605

[22] Filed: Mar. 25, 1986

[30] Foreign Application Priority Data

Mar. 26, 1985 [GB] United Kingdom ..... 8507796

[51] Int. Cl.[4] ..... A42B 7/00

[52] U.S. Cl. ..... 24/590; 24/701; 2/421

[58] Field of Search ..... 24/590, 701, 298, 658, 24/702, 453, 598, 580, 69 SK, 70 SK, 20 EE; 2/421

[56] References Cited

U.S. PATENT DOCUMENTS

| | | | |
|---|---|---|---|
| 514,231 | 2/1894 | Knothe | 24/701 |
| 3,643,295 | 2/1972 | Schoch | 24/70 SK |
| 3,990,113 | 11/1976 | Coenen | 2/421 |
| 4,347,630 | 9/1982 | Arai et al. | 2/421 |
| 4,398,306 | 8/1983 | Gooding | 2/421 |
| 4,470,175 | 9/1984 | Chiarella | 24/70 SK |
| 4,524,495 | 6/1985 | Hess | 24/701 |

FOREIGN PATENT DOCUMENTS

| | | | |
|---|---|---|---|
| 804297 | 4/1951 | Fed. Rep. of Germany | 24/701 |
| 806004 | 6/1951 | Fed. Rep. of Germany | 24/701 |
| 1069214 | 7/1954 | France | 24/701 |
| 72748 | 10/1947 | Norway | 24/701 |

*Primary Examiner*—Victor N. Sakran

*Attorney, Agent, or Firm*—Stevens, Davis, Miller & Mosher

[57] ABSTRACT

An oronasal mask assembly means suitable for and having a quick release assembly use in conjunction with a protective helmet is described.

An oronasal mask assembly means suitable for use in conjunction with a protective helmet and having a quick release mechanism, the quick release assembly having a mask retaining clip, engageable with a helmet mounted clip retaining means in the form of a pillar having an enlarged head portion, the mask retaining clip is attached to the mask via a cable length adjuster and cable.

4 Claims, 4 Drawing Figures

ORONASAL MASK ASSEMBLIES

FIELD OF THE INVENTION

The present invention relates to oronasal mask assemblies and retention and quick release mechanisms therefor. It is particularly concerned with the retention and quick release mechanisms used in conjunction with protective helmets and retaining masks worn in conjunction with such helmets.

BACKGROUND OF THE INVENTION

In such retention devices it is important that they be proof against inadvertent operation, either by the wearer or as a result of the adverse conditions they may encounter whilst wearing such a helmet and mask combination. It is also important for such devices to be easy to operate and release in an emergency and it is also important that they do not cause injury to the wearer or damage to the helmet or other protective clothing worn by the person. Known button and stud devices have not been found to be satisfactory for particularly demanding applications such as those encountered by aircrew during ejection or parachutists where adverse conditions such as very high 'g' loadings and air blast conditions are encountered.

In known systems worn by, for example, aircrew there is provided a hook and eye system for retaining masks, the hook being attached by a threaded rod to the helmet, the threaded rod providing an adjustment means for adjusting the tension of the mask. The mask is retained by cable or chain means connected to a mask retaining eye engagable with the helmet mounted hook. Such systems are not easy to operate and are prone to inadvertent disconnection under certain conditions.

SUMMARY OF THE INVENTION

An object of the present invention is at least to mitigate the disadvantages of the prior art by providing an improved mask retaining means which is stronger, more secure and less prone to cause injury.

According to one aspect of the present invention there is provided an oronasal mask assembly retaining means for use in conjunction with a protective helmet to enable quick release therefrom, characterized in that the assembly having a base plate mountable on the helmet, a retaining pillar mounted on the base plate and having an enlargement at the head end, an oronasal mask retaining plate removably securable over the enlarged head portion of the pillar, a mask retaining cable, and a mask retaining cable length adjuster connected between the oronasal mask and retaining plate.

An advantage of the present invention is the use of the retaining plate which is easily securable over the enlargement of the head portion of the pillar to secure the mask to the helmet to provide a lighter weight and more positive device.

According to a second aspect of the present invention there is provided an oronasal mask assembly retaining means wherein the mask retaining plate is slotted, the slotted portion of the plate being passable over the enlargement of the head portion of said pillar and retainable by the pillar.

The slot is provided with an enlarged portion located at the end of the plate nearest the mask retaining cable so that the plate may be passed over the enlarged head portion of the pillar and be secured to the retaining pillar and will in normal use be retained on the pillar by the head portion.

According to a further aspect of the present invention an oronasal mask assembly is provided wherein said retaining plate is slotted, the slot in the plate being enlarged at or near an end so that the plate is passable over the enlarged head portion of the retaining pillar and slideable along the narrower neck portion of the pillar between the base plate and enlarged head portion, the enlarged head portion retaining the plate when the enlarged portion of the slot is slid away from enlarged head portion of the pillar.

Advantageously, disengagement of the retaining plate from the pillar requires considerable rotation of the plate about a circumferential axis of the pillar, the rotation being far greater than that which would be available to the wearer in normal use.

An oronasal mask assembly retaining means is also provided which is characterized in that the mask retaining means is a slotted plate, the slotted plate being passable over the head portion of the pillar when said pillar and slotted plate are in a particular alignment, the alignment occurring at times of engagement and disengagement and not occurring in normal usage.

Advantageously the provision of two flat parallel sides on the enlarged head of the pillar and the slotted plate permits the plate to be disengaged only when the slot is aligned with flat parallel surfaces, the alignment being arranged so that it only occurs when engagement and disengagement of the plate is desired, thus being at an orientation that is not normally encountered. Such an arrangement permits the retaining plate to be easily slotted over the retaining pillar.

BRIEF DESCRIPTION OF THE DRAWINGS

In order that the present invention may be more clearly understood, embodiments will now be described by way of example only with respect to the accompanying drawings, of which.

DETAILED DESCRIPTION OF THE INVENTION

Figure 1:
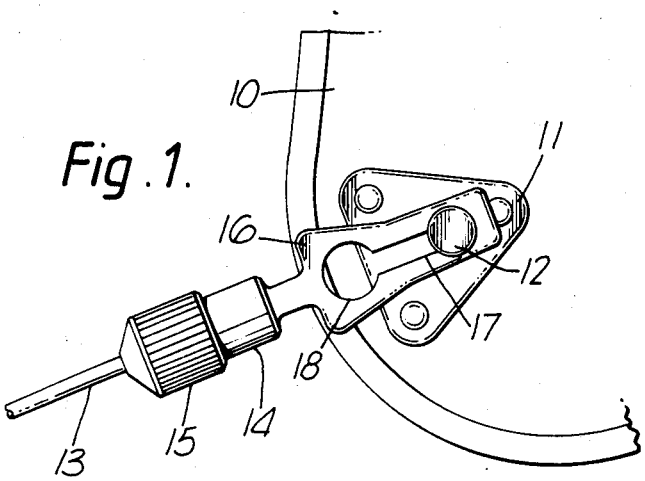
FIG. 1 shows a general arrangement of an example of a retaining assembly secured to a protective helmet.

Referring now to the figures in detail:

FIG. 1 shows a retaining plate or clip attached to the outside portion near the edge of the protective helmet 10. The helmet supports a base plate which is securely mounted thereto. Mounted on the base plate is a protruding pillar having an enlarged head portion 12. The mask assembly (not shown) has attached to it a retaining cable 13. The mask retaining cable 13 is connected to a cable length adjust 14, the cable length being adjustable by use of a knurled wheel 15. The cable length adjuster is connected flexibly by a ball and socket joint (not shown) to a mask retaining plate 16. The mask retaining plate 16 has along its length a long parallel sided slot 17 having an enlarged region 18 at one end.

The operation of the embodiment according to FIG. 1 will now be described in detail. The retaining plate 16 is shown in the assembled position. The retaining plate may rotate freely about the circumference of the pillar beneath the head portion 12, to accomodate movement of the wearer and also allow easy adaptation for different sizes and measurements of different wearers. In normal use the mask will be worn tightly pressed against the users face, fine adjustments (of e.g. ±2 cm) may be provided by rotation of the knurled wheel 15 of the cable adjuster 14.

The masks were frequently provided with a further mask tensioning device (not shown) to provide means for tensioning of the mask against the users face. In order to remove the retaining plate and release the mask, the retaining plate is moved by sliding it along the pillar until the enlarged portion of the slot 18 is aligned with the head portion 12, whereupon the retaining plate may easily be pushed over the head portion. The pillar may be provided with additional guide means to ensure easy quick release of the retaining plate from the pillar.

Figure 2:
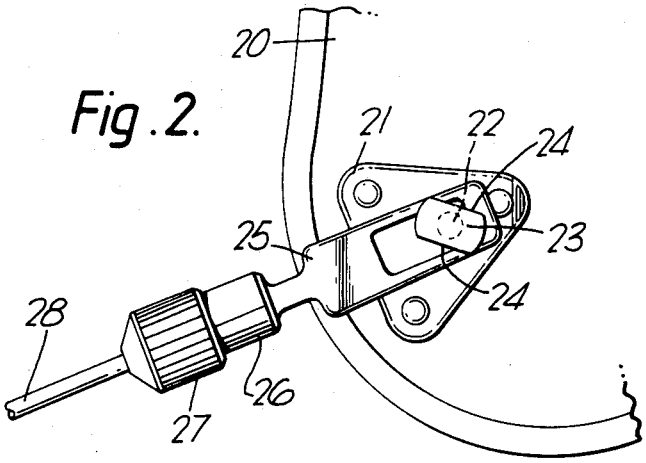
FIG. 2 shows an alternative embodiment of the present invention.

FIG. 2 shows an alternative embodiment of the present invention. The device is shown mounted on the outside of a protective helmet 20. A base plate 21 supports a pillar 22 having an enlarged head portion 23. The head portion may conveniently be of domed construction to ease the engagement of retaining plate 25 on the mask. The head portion is provided with two substantially parallel flat sides 24.

The retaining plate 25 is the form of a flat plate with an elongate slot along its length. The retaining plate 25 is flexibly connected to a cable length adjuster 26, the adjustment of the cable being provided by rotation of the knurled nut 27. The mask retaining cable 28 extends from the end of the adjuster.

Figure 3B:
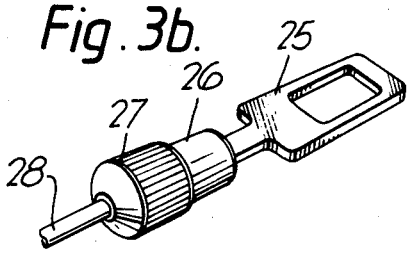
FIGS. 3*a* and 3*b* show the components of FIG. 2 separated from one another.
Figure 3A:
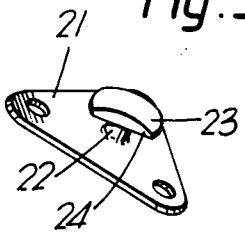

FIGS. 3*a* and 3*b* illustrate the two components separated from each other for the purpose of more clearly showing features.

In operation the assembly will be as shown in FIG. 2. Adjustment of the cable may be achieved by rotation of knurled wheel 26. Release of the retaining plate from the pillar is achieved by rotation of the retaining plate about the base plate until the slot is aligned with the flat sides of the head portion on the pillar. It can be seen in FIG. 3 that the corners and flat sides may be radiused and this been found to considerably ease the operation and permit quick release of the retaining plate from the helmet.

It will be appreciated that the particular orientation of the enlarged head portion and flat sides thereon may be set at any convenient angle to ensure that in normal operation the retaining plate does not become unsecured from the retaining bracket. Furthermore it will be readily appreciated that the retaining plates may be mounted at any convenient position inside the helmet shell as well as on the outside as illustrated and described.

It will be appreciated that the retaining plate means illustrated in these embodiments could be a stiff wire loop assembly but it is generally more satisfactory to provide a plate form, the greater stiffness facilitating the securing and releasing of the masks, particularly the quick release function.

I claim:

1. A retaining means for an oronasal mask assembly for use in conjunction with a protective helmet to facilitate quick release of the assembly from the helmet, the retaining means comprising:

a first part comprising (i) a base plate adapted to be mounted on the outside of the helmet, and (ii) a pillar extending outwardly from said base plate and having an enlarged, domed elongate head having parallel long sides and rounded apexes; and a second part including (i) a cable length adjuster, (ii) a retaining cable for connecting said mask assembly to one end of said adjuster, and (iii) a slotted plate which is flexibly connected to the other end of said adjuster and is adapted to pass over said domed head and to be retained by said pillar when the slot is aligned with the parallel sides of the head;

the first part being adapted to be so positioned on the helmet that when the mask assembly is retained on the helmet in its normal position, the slot makes an angle with the parallel sides of the head which is sufficient to prevent inadvertent separation of the first part and the second part of the retaining means during movement encountered in normal use but is not too great to prevent the first part and the second part of the retaining means from being separated manually.

2. A retaining means for an oronasal mask assembly as claimed in claim 1, wherein said angle is substantially 45°.

3. A retaining means for an oronasal mask assembly as claimed in claim 1, wherein the enlarged domed head has two substantially flat, parallel surfaces, said surfaces being substantially perpendicuar to said base plate and being arranged such that the slotted plate can pass over said head when the head and slotted plate are aligned, alignment of said head and slotted plate being achieved by rotation of the slotted plate about said pillar to a position normally encountered only during intentional engagement and disengagement of the first and the second part of the retaining means.

4. A retaining means for an oronasal mask assembly in combination with a protective helmet to facilitate quick release of the assembly from the helmet, said retaining means conprising a first retaining unit and a second retaining unit, each retaining unit comprising:

a first part comprising (i) a base plate adapted to be mounted on the outside of the helmet, and (ii) a pillar extending outwardly from said base plate and having an enlarged, domed elongate head having parallel long sides and rounded apexes; and a second part including (i) a cable length adjuster, (ii) a retaining cable for connecting said mask assembly to one end of said adjuster, and (iii) a slotted plate which is flexibly connected to the other end of said adjuster and is adapted to pass over said domed head and to be retained by said pillar when the slot is aligned with the parallel sides of the head;

the first part being adapted to be so positioned on the helmet that when the mask assembly is retained on the helmet in its normal position, the slot makes an angle with the parallel sides of the head which is sufficient to prevent inadvertent separation of the first part and the second part of the retaining means during movement encountered in normal use but is not too great to prevent the first part and the second part of the retaining means from being separated manually, said first part of said retaining unit being connected to one side of said helmet and said first part of said second retaining unit being connected to the opposite side of said helmet, said second part of said first retaining unit being connected to a side of said mask assembly corresponding to said side of said helmet at which said first part of said first retaining unit is connected, and said second part of said second retaining unit being connected to the opposite side of said mask assembly.

* * * * *